US008322062B1

(12) United States Patent
Engelby et al.

(10) Patent No.: US 8,322,062 B1
(45) **Date of Patent: *Dec. 4, 2012**

(54) IN-STORE MARKETING SIGN

(75) Inventors: Daniel G. Engelby, Andover, MN (US); Christopher H. Kaye, Buffalo, MN (US); Gary L. Sotebeer, Eden Prairie, MN (US)

(73) Assignee: Target Brands, Inc., Minneapolis, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/439,452

(22) Filed: Apr. 4, 2012

Related U.S. Application Data

(63) Continuation of application No. 13/154,830, filed on Jun. 7, 2011, now Pat. No. 8,171,663, which is a continuation of application No. 12/356,015, filed on Jan. 19, 2009, now Pat. No. 7,992,334.

(51) Int. Cl.
*G09F 3/18* (2006.01)

(52) U.S. Cl. ..... 40/661.03

(58) Field of Classification Search ..... 40/642.2, 40/649, 661, 642.07, 657, 661.03, 661.08, 40/672

See application file for complete search history.

(56) References Cited

U.S. PATENT DOCUMENTS

| | | | |
|---|---|---|---|
| 362,758 | A | 5/1887 | Martin |
| 1,174,299 | A | 3/1916 | Taylor |
| 1,407,464 | A | 2/1922 | Garbe |
| 1,608,294 | A | 11/1926 | Beman |
| 2,108,343 | A | 2/1938 | McAllister |
| 2,288,728 | A | 7/1942 | Meredith |
| 2,297,888 | A | 10/1942 | Heileman |
| D134,298 | S | 11/1942 | Eppenstein |
| 2,720,044 | A | 10/1955 | Montalto |
| 2,833,074 | A | 5/1958 | Jannes |
| 2,984,031 | A | 5/1961 | Giesecke |
| 3,077,686 | A | 2/1963 | Montalto |
| 3,251,152 | A | 5/1966 | Takefman |
| 3,423,860 | A | 1/1969 | Berry, Jr. et al. |
| 3,706,150 | A | 12/1972 | Greenberger |
| 3,709,150 | A | 1/1973 | Colombot |
| 3,711,977 | A | 1/1973 | Blankenhorn |

(Continued)

FOREIGN PATENT DOCUMENTS

FR 2870379 A1 11/2005

OTHER PUBLICATIONS

Application and prosecution documents associated with U.S. Appl. No. 13/154,830 including: The application entitled In-Store Marketing Sign, filed Jun. 7, 2011, pp. 1-27; Office Action dated Aug. 8, 2011, pp. 28-38; Amendment dated Oct. 27, 2011, pp. 39-44; Notice of Allowance dated Jan. 30, 2012, pp. 45-51.

(Continued)

*Primary Examiner* — Tashiana Adams
*Assistant Examiner* — Shin Kim
(74) *Attorney, Agent, or Firm* — Leanne Taveggia Farrell; Westman, Champlin & Kelly, P.A.

(57) ABSTRACT

A marketing sign is constructed of a sheet material. The sheet material includes a free portion, a base portion and a connecting portion that couples the base portion to the free portion. The base portion is configured to engage with a product display structure, which has a price holder. The connecting portion is defined between a first connecting bend line spaced apart from a second connecting bend line by a distance. The distance substantially corresponds with an edge thickness of the price holder.

20 Claims, 9 Drawing Sheets

U.S. PATENT DOCUMENTS

| | | | |
|---|---|---|---|
| 3,774,328 | A | 11/1973 | Tanney |
| 3,824,720 | A | 7/1974 | Langwell |
| D233,083 | S | 10/1974 | Rosa |
| 3,977,109 | A | 8/1976 | Berry, Jr. et al. |
| D241,718 | S | 10/1976 | Hourahine |
| 4,141,529 | A | 2/1979 | Casutt |
| 4,161,074 | A | 7/1979 | DePinna |
| 4,167,073 | A | 9/1979 | Tang |
| 4,179,138 | A | 12/1979 | Bogdanovic |
| 4,306,366 | A | 12/1981 | Taub |
| 4,338,739 | A | 7/1982 | Greenberger |
| 4,471,544 | A | 9/1984 | Nelles et al. |
| 4,572,380 | A | 2/1986 | Langwell |
| 4,693,441 | A | 9/1987 | Conway |
| 4,713,899 | A | 12/1987 | Fast |
| 4,716,669 | A | 1/1988 | Fast |
| 4,718,627 | A | 1/1988 | Fast et al. |
| 4,798,014 | A | 1/1989 | Stoerzinger et al. |
| 4,919,377 | A | 4/1990 | Alexander et al. |
| 4,930,234 | A | 6/1990 | Schmidt |
| D338,241 | S | 8/1993 | Landa |
| 5,682,698 | A | 11/1997 | Bevins |
| 5,709,297 | A | 1/1998 | Brandriff et al. |
| 5,848,698 | A | 12/1998 | Stompe |
| D415,206 | S | 10/1999 | Gaines |
| 5,967,343 | A | 10/1999 | Dufresne |
| D427,526 | S | 7/2000 | Correll |
| 6,145,232 | A | 11/2000 | Bevins |
| 6,163,996 | A | 12/2000 | Gebka |
| 6,193,457 | B1 | 2/2001 | Pacione |
| 6,283,278 | B1 | 9/2001 | Holztrager |
| 6,360,465 | B1 | 3/2002 | Simpson |
| 6,516,546 | B1 | 2/2003 | Bremick |
| D480,754 | S | 10/2003 | Berger |
| 6,701,653 | B2 | 3/2004 | Chess et al. |
| D498,843 | S | 11/2004 | Kielb et al. |
| 6,817,127 | B2 | 11/2004 | Gottlieb et al. |
| D502,031 | S | 2/2005 | Cassidy et al. |
| D504,159 | S | 4/2005 | Best et al. |
| 6,981,343 | B2 | 1/2006 | Rawlings et al. |
| 7,055,274 | B2 | 6/2006 | Fast et al. |
| 7,219,459 | B2 | 5/2007 | Valiulis et al. |
| D554,921 | S | 11/2007 | Gordon et al. |
| D556,265 | S | 11/2007 | Cuzzocrea |
| 7,340,855 | B2 | 3/2008 | Wiltfang et al. |
| D575,332 | S | 8/2008 | Parker et al. |
| 7,578,088 | B2 | 8/2009 | Alves |
| 7,587,849 | B2 | 9/2009 | Robbins et al. |
| D608,395 | S | 1/2010 | Engelby et al. |
| D623,235 | S | 9/2010 | Engelby et al. |
| D623,236 | S | 9/2010 | Engelby et al. |
| D630,257 | S | 1/2011 | Engelby et al. |
| D633,570 | S | 3/2011 | Hilyard et al. |
| 7,975,416 | B2 | 7/2011 | Engelby et al. |
| 7,992,334 | B1 | 8/2011 | Engelby et al. |
| D647,572 | S | 10/2011 | Engelby |
| D650,018 | S | 12/2011 | Engelby |
| D651,653 | S | 1/2012 | Engelby |
| 2002/0070266 | A1 | 6/2002 | Glenn et al. |
| 2003/0020274 | A1 | 1/2003 | Milliorn |
| 2004/0124629 | A1 | 7/2004 | Davis et al. |
| 2004/0211820 | A1 | 10/2004 | Berger |
| 2005/0155259 | A1 | 7/2005 | Virvo |
| 2006/0010742 | A1 | 1/2006 | Steininger |
| 2007/0241004 | A1 | 10/2007 | Squarzoni et al. |

OTHER PUBLICATIONS

Application and prosecution documents associated with U.S. Appl. No. 13/155,149 including: The application entitled In-Store Marketing Sign, filed Jun. 7, 2011, pp. 1-29; Office Action dated Sep. 1, 2011, pp. 30-35; Amendment dated Nov. 17, 2011, pp. 36-44; Office Action dated Feb. 14, 2012, pp. 45-51.

Pending U.S. Appl. No. 13/210,846, filed Aug. 16, 2011 entitled In-Store Marketing sign, pp. 1-48.

Pending U.S. Appl. No. 29/399,587, filed Aug. 16, 2011 entitled In-Store Marketing sign, pp. 1-10.

Communication dated Mar. 9, 2012 in Canadian application No. 2,759,938, 3 pages.

IN-STORE MARKETING SIGN

CROSS-REFERENCE TO RELATED APPLICATION

The present application is a continuation of and claims priority to U.S. patent application Ser. No. 13/154,830, filed Jun. 7, 2011, which is a continuation of U.S. patent application Ser. No. 12/356,015, filed Jan. 19, 2009, now U.S. Pat. No. 7,992,334. All of the above-referenced applications are incorporated herein by reference in their entirety.

BACKGROUND

Retail establishments commonly use various types of display structures to present products to customers for purchase. These display structures both support the product for display and indicate the product price. Example display structures include shelf-type structures and peg-type structures.

In general, shelf-type display structures display the product by resting it on shelves. Each shelf has a channel that holds a shelf-type price label support that supports a price label along the front of the shelf. The price label provides pricing and product information for the products stacked on the shelves.

Peg-type display structures generally display products by hanging the products from a peg. Typically, each peg-type display structure includes a top peg fixture for supporting a price label support that supports a price label and a bottom peg fixture for supporting products.

Often, retailers desire to highlight certain products that are being displayed for sale. For example, a retailer may want to bring certain products to the attention of the customer because they were advertised in a certain media format, such as a catalog, a mailer or a commercial. In another example, a retailer may want to highlight certain products that have certain characteristics not possessed by similarly displayed products, such as products that are on sale or products that offer promotional incentives with its purchase. In yet another example, a retailer may want to temporarily change the prices of certain products to reflect a sale price.

Often, retailers highlight these select products by enhancing the visual appearance of the price labels by adding additional visual elements that extend beyond the normal price label or cover the regular price label so as to draw attention to the product.

Enhancing the visual appearance of products on display can be labor intensive when performed across an entire store. In particular, to support a sign having a new price label over the regular price on a shelf-type or peg-type display structure can require use of an additional type of holder, such as a plastic holder. The need of an additional holder, to hold the signs, adds steps to the process of highlighting a product, which affects the efficiency and time needed to accomplish such a task.

The discussion above is merely provided for general background information and is not intended to be used as an aid in determining the scope of the claimed subject matter.

SUMMARY

A marketing sign is made of a sheet material. The sheet material includes a free portion, a base portion and a connecting portion that couples the base portion to the free portion. The base portion is configured to engage with a product display structure, which has a price holder. The connecting portion is defined between a first connecting bend line spaced apart from a second connecting bend line by a distance. The distance substantially corresponds with an edge thickness of the price holder.

A product display structure includes a price holder support structure and a price holder coupled to the price holder support structure. The price holder is configured to retain a price label and includes a top edge having an edge thickness. The distance between the first connecting bend line and the second connecting bend line of the marketing sign corresponds to the edge thickness of the top edge of the price holder such that the connecting portion wraps around the top edge and the free portion lies substantially normal to the top edge.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter. The claimed subject matter is not limited to implementations that solve any or all disadvantages noted in the background.

DETAILED DESCRIPTION

Embodiments described herein utilize an in-store marketing sign made from a sheet material to enhance or highlight various products being supported on a display structure. The marketing sign is designed such as to be able to wrap itself around a top edge of a price label support on a variety of different types of product display structures. For example, the marketing sign can be utilized with a shelf-type display structure, which includes a price label support for supporting at least one price label. The marketing sign can also be utilized with a peg-type display structure, which includes a price label support coupled to a peg fixture.

Figure 1:
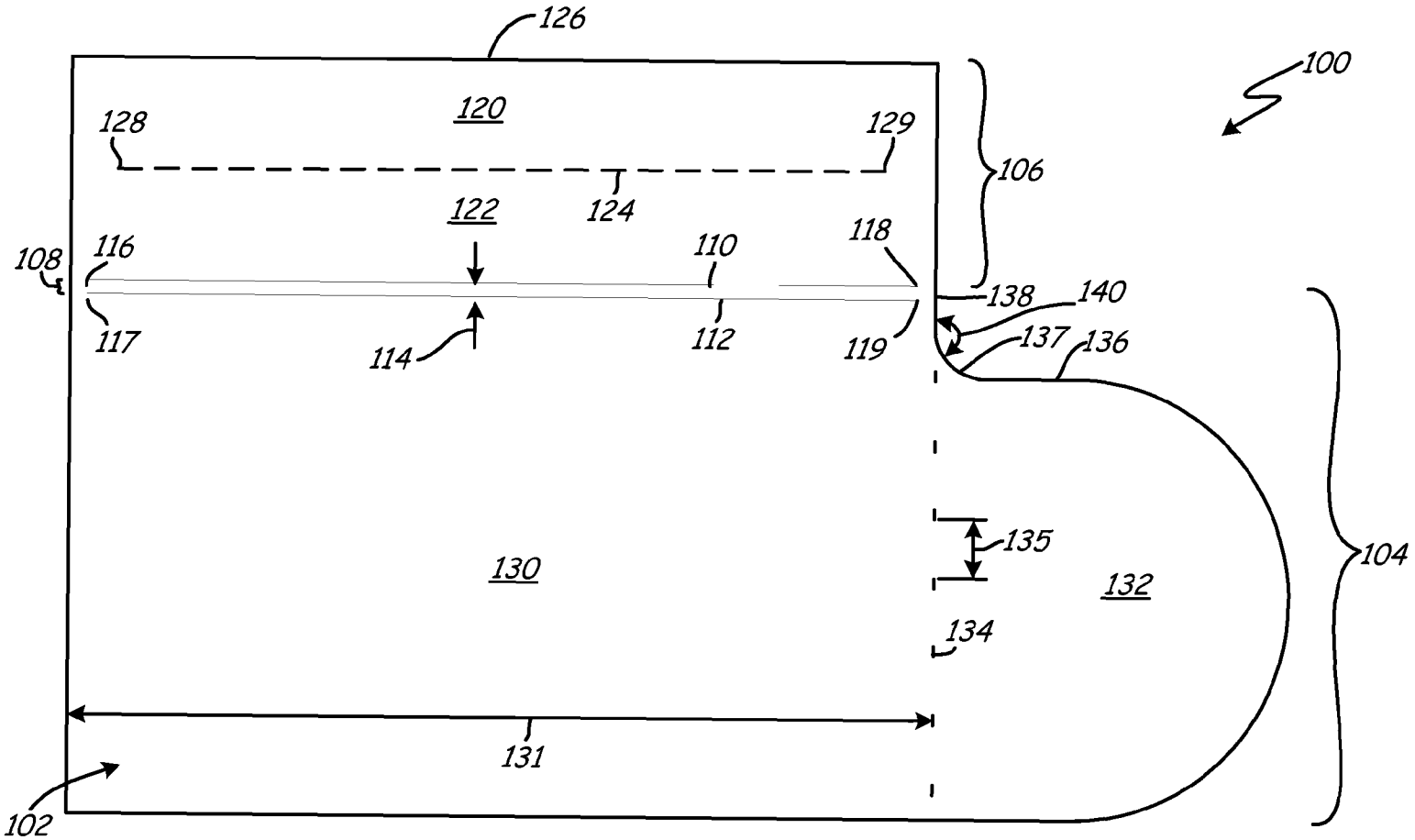
FIG. 1 is a front view of an in-store marketing sign for a shelf-type display structure under one embodiment.

FIG. 1 is a front view of a marketing sign 100 showing a first surface 102 under one embodiment. Marketing sign 100 is for use with a shelf-type product display structure and is formed with a pliable yet resilient sheet material. One exemplary sheet material includes polystyrene; however, other resilient sheet materials may be used. The marketing sign 100 can be manufactured with a variety of different types of punch and die machines and/or laser machines.

Marketing sign 100 includes a free portion 104, a base portion 106 and a connecting portion 108, which couples the free portion 104 to the base portion 106. Connecting portion 108 is defined between a first connecting bend line 110 spaced apart from a second connecting bend line 112. First connecting bend line 110 and second connecting bend line 112 are spaced apart by a distance 114. For example, distance 114 can be about 2 mm. In one embodiment, first connecting bend line 110 and second connecting bend line 112 are continuous grooves extending from first ends 116 and 117 to second ends 118 and 119. However, it should be realized that first connecting bend line 110 and second connecting bend line 112 can be other types of suitable markings, such as slits, scores or perforations that would aid in easily bending the sheet material along the marking. First ends 116 and 117 are spaced apart from a side edge of marketing sign 100 by about 1.5 mm and second ends 118 and 119 are spaced apart from the other side edge of marketing sign 100 by about 1.5 mm.

Base portion 106 includes an engaging piece 120 coupled to a support piece 122 at a base bend line 124. Base bend line 124 is oriented substantially parallel with the first and second connecting bend lines 110 and 112. In one embodiment, base bend line 124 includes a plurality of spaced apart slits extending from a first end 128 to a second end 129. However, it should be realized, as discussed in regards to other bend lines, base bend line 124 can be other types of suitable markings, such a continuous groove, a score or perforations that would aid in easily bending the sheet material along the marking.

Engaging piece 120 is defined between a base edge 126 and base bend line 124. Support piece 122 is defined between first connecting bend line 110 and base bend line 124. In other words, connecting portion 108 couples support piece 122 of base portion 106 to free portion 104 such that first connecting bend line 110 is adjacent support piece 122 and second connecting bend line 112 is adjacent free portion 104.

Free portion 104 includes a price piece 130 coupled to a balloon piece 132 at a free bend line 134. Price piece 130 of marketing sign 100 is sized such that its width 131 is about 127 mm or 5 inches. Free bend line 134 is oriented substantially normal to the first and second connecting bend lines 110 and 112. In one embodiment, free bend line 134 includes a plurality of spaced apart slits. For example, the plurality of slits can extend for a length of about 2 mm and each slit can be spaced apart from each other by a distance 135 of about 7 mm. Such a distance 135 provides a resilient connection between price piece 130 and balloon piece 132 while still allowing free bend line 134 to bend easily. However, it should be realized, as discussed in regards to other bend lines, free bend line 134 can have slits spaced apart from each other at other distances. In addition, free bend line 134 can be other types of suitable markings, such a continuous groove, a score or perforations that would aid in easily bending the sheet material along the marking.

Balloon piece 132 includes a top edge 136 spaced apart and below second connecting bend line 112. Price piece 130 includes a side edge 138 located between second connecting bend line 112 and top edge 136 of balloon piece 132. Side edge 138 is oriented substantially normal with respect to first and second connecting bend lines 110 and 112. Top edge 136 of balloon piece 132 intersects with side edge 138 of price piece 130 at an angle 140 that is greater than 90 degrees and less than 180 degrees. In the embodiment illustrated in FIG. 1, at least a portion 137 of top edge 136 can be curved such that it forms a concave shape. For example, the curved portion 137 can have a concave shape that includes a radius of curvature of about 6.35 mm or 0.25 inches. However, it should be realized that the curved portion 137 of top edge 136 can include other radii and other shapes. For example, instead of a portion of top edge 136 including a curved, concave shape, the portion of top edge 136 can include a curved, convex shape. In another example, the portion 137 of top edge 136 that is curved could instead be linear and still intersect with side edge 138 at an angle 140 greater than 90 degrees and less than 180 degrees.

Figure 2:
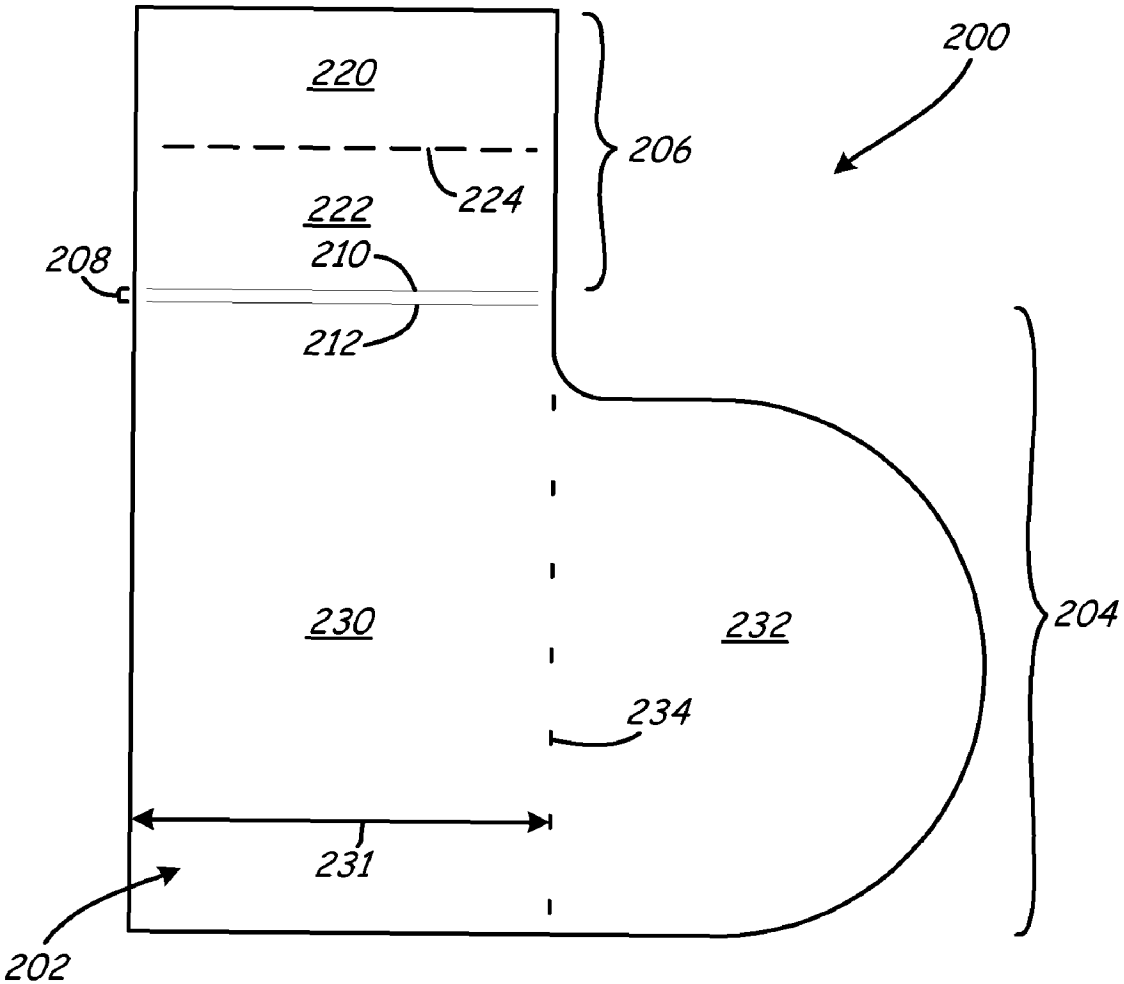
FIG. 2 is a front view of an in-store marketing sign for a shelf-type display structure under another embodiment.

FIG. 2 is a front view of a marketing sign 200 showing a first surface 202 under another embodiment. Like marketing sign 100, marketing sign 200 is for use with a shelf-type product display structure and is formed with a pliable yet resilient sheet material.

Marketing sign 200 includes a free portion 204, a base portion 206 and a connecting portion 208, which couples the free portion 204 to the base portion 206 as similar to marketing sign 100. Connecting portion 208 is defined between a first connecting bend line 210 spaced apart from a second connecting bend line 212. Base portion 206 includes engaging piece 220 coupled to support piece 222 at a base bend line 224. Free portion 204 includes a price piece 230 coupled to a balloon 232 at a free bend line 234. As illustrated, marketing sign 200 is no different than marketing sign 100, except, price piece 230 of marketing sign 200 is sized such that its width 231 is about 50.8 mm or 2 inches.

Figure 3:
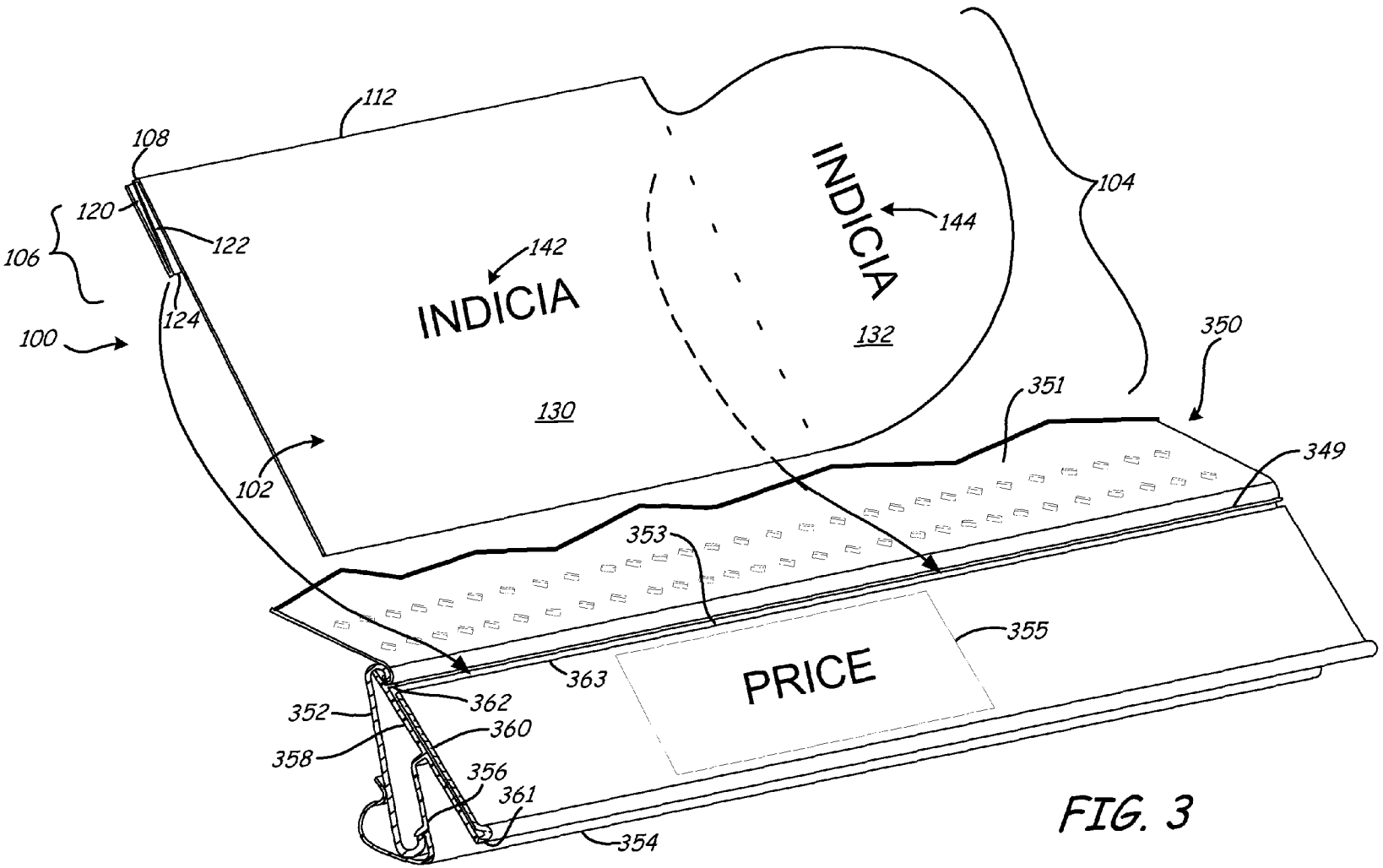
FIG. 3 is a perspective view of the in-store marketing sign illustrated in FIG. 1 as exploded from a perspective sectional view of a shelf-type display structure under one embodiment.

FIG. 3 is a perspective view of marketing sign 100 illustrated in FIG. 1 as exploded from a perspective sectional view of a shelf-type display structure 350 under one embodiment. It should be noted that while FIG. 3 illustrates marketing sign 100, it should be realized that shelf-type-display structure 350 can also accommodate marketing sign 200 illustrated in FIG. 2.

In FIG. 3, marketing sign 100 is bent at its bend lines. For example, first and second connecting bend lines 110 (not specifically pointed out in FIG. 3) and 112 are bent such as to define connecting portion 108. Base bend line 124 is bent to define engaging piece 120 and support piece 122. As illustrated in FIG. 3, base bend line 124 is folded such that engaging piece 120 is laid against support piece 122. With this fold, support piece 122 is located closer to free portion 104 than engaging piece 120. Free bend line 134 is bent such that balloon piece 132 protrudes from first surface 102 of price piece 130.

Shelf-type display structure 350 includes a shelf 351 coupled to a price holder support structure or channel 352 at a bull nose 349. Channel 352 is oriented at an angle from shelf 351. Channel 352 is configured to retain a price holder 354. As more easily illustrated in the perspective section in FIG. 3 of price holder 354, the price holder is an integrally formed component configured to retain a price label strip 353 having a plurality of price labels 355 (of which one price label is shown in FIG. 3). Price holder 354 is typically formed of a polymer such as plastic. Price holder 354 includes a support 356 configured to engage with channel 352. Price holder 354 also includes a back side 358 coupled to a front side 360 at a joined bottom end portion 361. At least front side 360 is formed of a transparent polymer such that a price label 355 can be clearly viewed. Front side 360 includes a top edge 363. Back side 358 includes an extension 362 located in proximity to the top of the back side. Extension 362 protrudes from the back side 358 towards top edge 363 of front side 360 and is located just below or in contact with bull nose 349 of display structure 350. It should be realized, back side 358 and front side 360 are coupled together at jointed bottom end portion 361 only and not at top ends. Price label strip 353 can be inserted between the back side 358 and the front side 360 of price holder 354 from the side or top down. Extension 362 or bull nose 349 secures price label strip 353 into place.

Marketing sign 100 is configured to be bent. More specifically, base portion 106 is folded and then inserted between back side 358 and front side 360 of price holder 354 so as to cover the regular price label 355 of price label strip 353. In other words, base portion 106 of marketing sign 100 is configured to engage with or couple to a price holder 354, which is coupled to display structure 350.

In one embodiment, price piece 130 includes indicia 142 indicative of a price of a product and product information of which sign 100 is marketing and balloon piece 132 includes indicia 144 indicative of promotional information about the product the sign 100 is marketing. Upon marketing sign 100 covering the regular price label 355, marketing sign indicates a new price with indicia 142 located on price piece 130 and further highlights promotional features of the product with indicia 144 located on balloon piece 132. As illustrated, indicia 144 are located on a front side 102 of balloon piece 132. Indicia are also located on a back side of balloon piece 132 (not specifically illustrated) such that indicia on balloon piece 132 are double sided.

Figure 4:
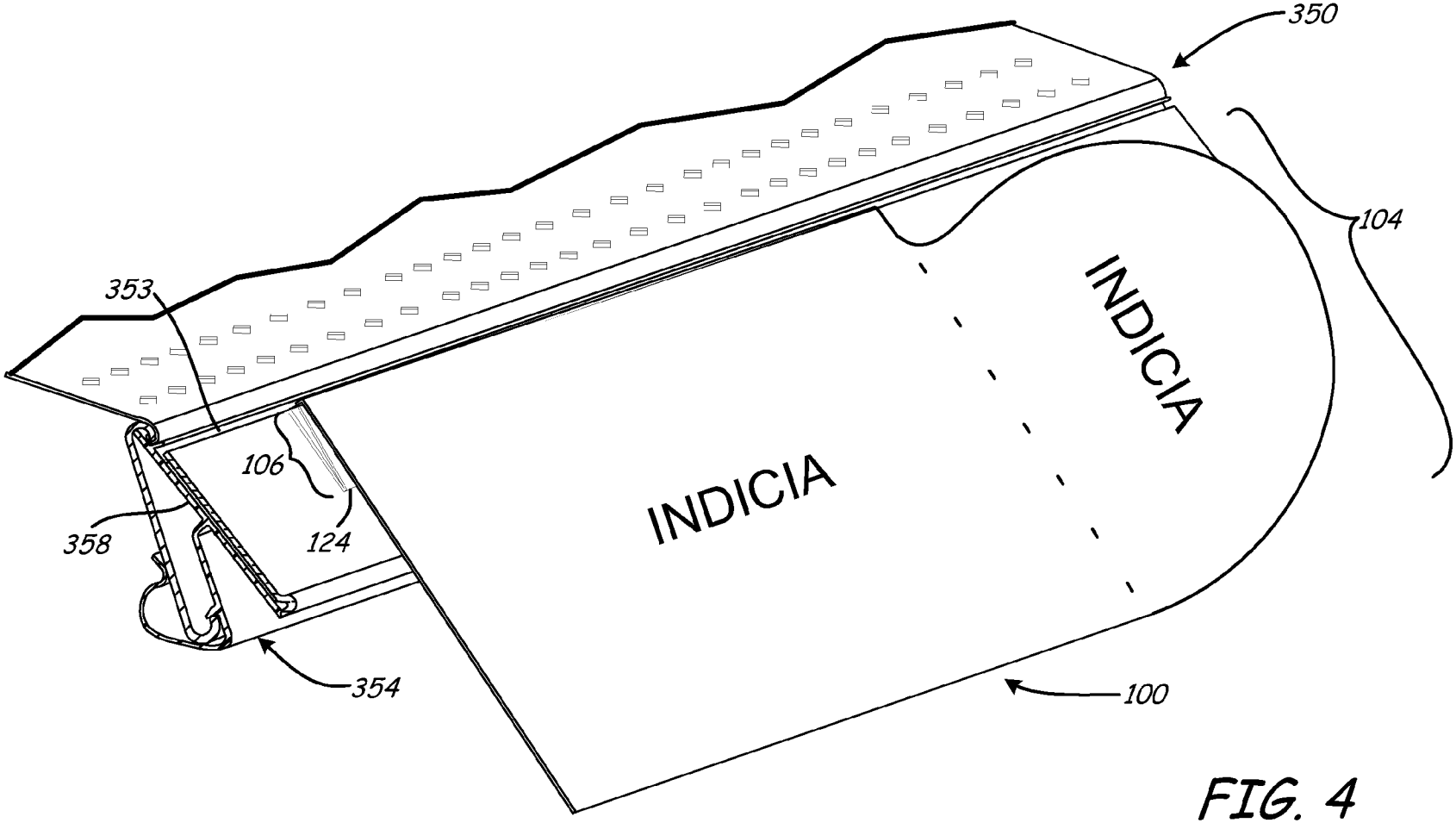
FIG. 4 is a perspective view of the in-store marketing sign illustrated in FIG. 1 as mounted to the perspective sectional view of the shelf-type display structure illustrated in FIG. 3.
Figure 5:
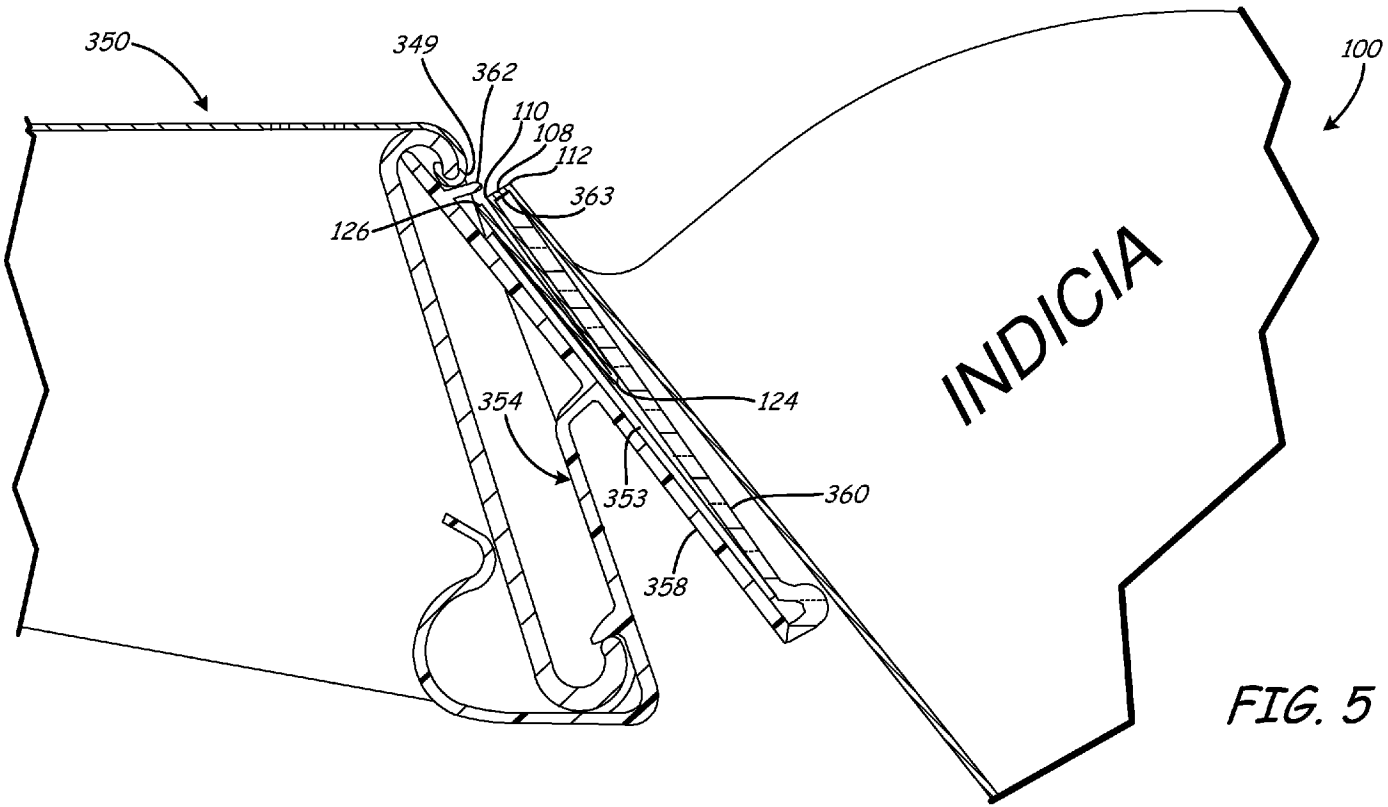
FIG. 5 is a side view of the in-store marketing sign mounted to the side sectional view of the shelf-type display structure illustrated in FIG. 4

FIG. 4 is a perspective view of marketing sign 100 as mounted to a perspective sectional view of shelf-type display structure 350. FIG. 5 is a side view of marketing sign 100 and shelf-type display structure 350 of FIG. 4. As illustrated in FIGS. 4 and 5, base portion 106 (FIG. 4) including folded engaging piece 120 (FIG. 5) and support piece 122 (FIG. 5) of marketing sign 100 are inserted between back side 358 and front side 360 of price holder 354 and in front of price label strip 353. It should be pointed out, in other embodiments, base portion 106 including engaging piece 120 and support piece 122 of marketing sign 100 are inserted between back side 358 and front side 360 of price holder 354 and behind price label strip 353. As discussed above, base bend line 124 is folded such that engaging piece 120 is laid against support piece 122. With this fold, support piece 122 is located closer to free portion 104 (FIG. 4) than engaging piece 120. In such a configuration, base edge 126 (FIG. 5) can engage with extension 362 (FIG. 5) of price holder 354 or bull nose 349 of display structure 350 to prevent marketing sign 100 from sliding upward and out of the price holder.

As illustrated in FIG. 5, connecting portion 108 defined by first and second connecting bend lines 110 and 112, which are spaced apart by distance 114 (FIG. 1), is sized to correspond with a thickness of top edge 363 of front side 360. By connecting portion 108 being sized to correspond with a thickness of top edge 363, the top edge 363 is allowed to support marketing sign 100 at first and second connecting bend lines 110 and 112 and be in contact with connecting portion 108.

Figure 6:
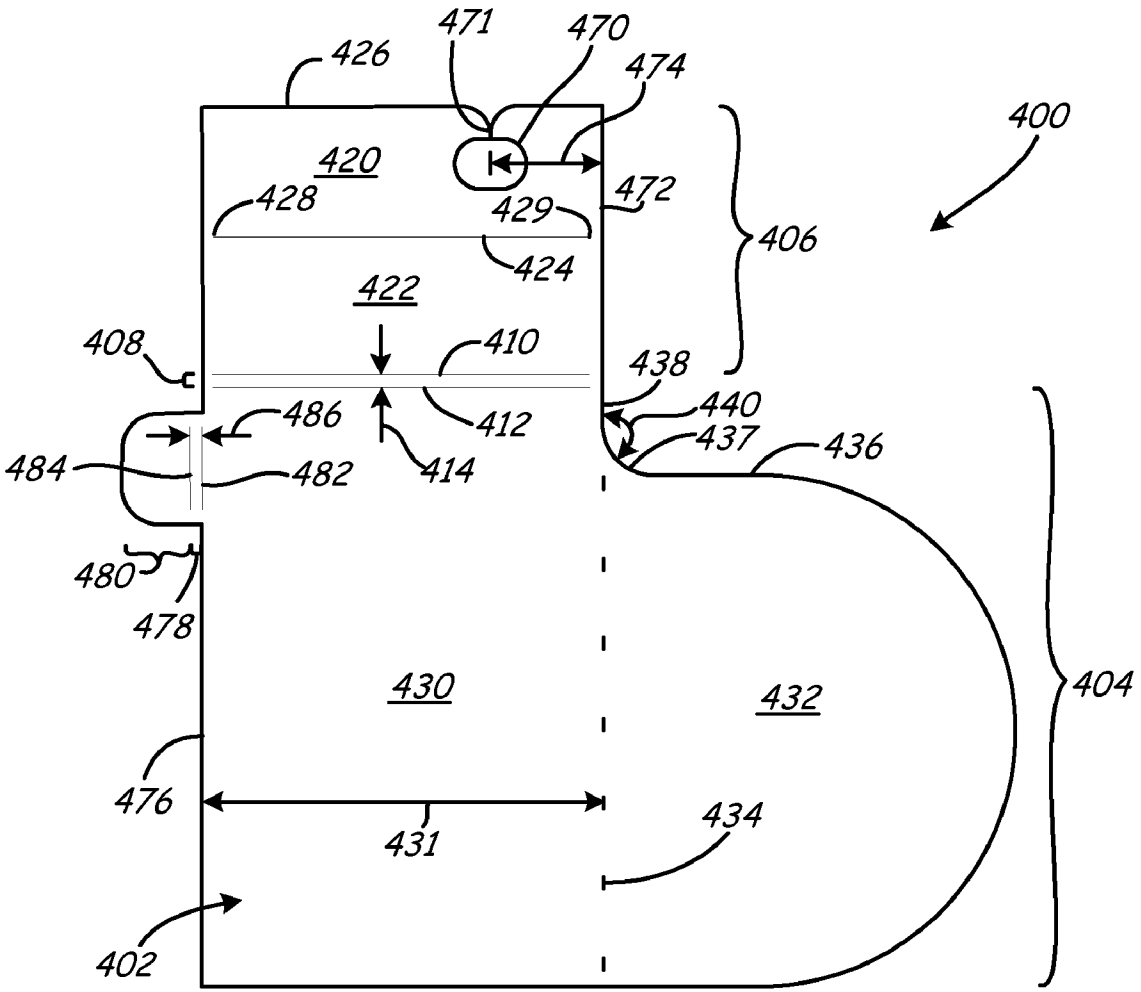
FIG. 6 is a front view of an in-store marketing sign for a peg-type display structure under one embodiment.

FIG. 6 is a front view of a marketing sign 400 showing a first surface 402 under one embodiment. Like marketing sign 100 and 200, marketing sign 400 is formed with a pliable yet resilient sheet material. Unlike marketing sign 100 and 200, marketing sign 400 is for use with a peg-type product display structure. Similar to marketing signs 100 and 200, marketing sign 400 includes a free portion 404, a base portion 406 and a connecting portion 408, which couples the free portion 404 to the base portion 406.

Connecting portion 408 is defined between a first connecting bend line 410 spaced apart from a second connecting bend line 412 by a distance 414. For example, distance 414 can be about 2 mm. Base portion 406 includes engaging piece 420 coupled to support piece 422 at a base bend line 424. As illustrated in FIG. 6, base bend line 424 is oriented substantially parallel with the first and second connecting bend lines 410 and 412. In one embodiment, base bend line 424 includes a continuous groove extending from a first end 428 to a second end 429. However, it should be realized, as discussed in regards to other bend lines, base bend line 424 can be other types of suitable markings, such spaced apart slits, a score or perforations that would aid in easily bending the sheet material along the marking.

Engaging piece 420 is defined between a base edge 426 and base bend line 424. Support piece 422 is defined between first connecting bend line 410 and base bend line 424. In other words, connecting portion 408 couples support piece 422 of base portion 406 to free portion 404 such that first connecting bend line 410 is adjacent support piece 422 and second connecting bend line 412 is adjacent free portion 404.

Unlike marketing signs 100 and 200, engaging piece 420 of base portion 406 includes an aperture 470. The center of aperture 470 is spaced from a side edge 472 of base portion 406 by a distance 474. For example, distance 474 can be about 14.8 mm. Aperture 470 is in communication with base edge 426 via slot 471. In other words, base edge 426 has a point of discontinuity such that base edge 426 is in communication with aperture 470.

Like marketing signs 100 and 200, free portion 404 includes a price piece 430 coupled to a balloon piece 432 at a free bend line 434. Free bend line 434 includes spaced apart slits as discussed and illustrated in FIG. 1. Price piece 430 of marketing sign 400 is sized such that its width 431 is about 50.8 mm or 2 inches. Like marketing signs 100 and 200, balloon piece 432 includes a top edge 436 spaced below second connecting bend line 412. Price piece 430 includes a first side edge 438 in alignment with side edge 472 of base portion 406. First side edge 438 of price piece 430 is oriented substantially normal with respect to first and second connecting bend lines 410 and 412. Top edge 436 of balloon piece 432 intersects with first side edge 438 of price piece 430 at an angle 440 that is greater than 90 degrees and less than 180 degrees. As previously discussed in regards to FIG. 1, at least a portion 437 of a top edge 436 of balloon piece 432 can be curved. However, it is also possible that at least a portion 437 of top edge 436 can instead be linear as long as the angle between first side edge 438 and top edge 436 is greater than 90 degrees and less than 180 degrees.

Price piece 430 also includes a second side edge 476. Along second side edge 476, a tab portion 480 is coupled to price piece 430 by a tab connecting portion 478. Tab connecting portion 478 is defined between a first tab bend line 482 spaced apart from a second tab bend line 484. First and second tab bend lines 482 and 484 are spaced apart by a distance 486. For example, distance 486 can be about 1.8 mm. In one embodiment, first and second tab bend lines 482 and 484 are continuous grooves. However, it should be realized that first and second tab bend lines 482 and 484 can be other types of suitable markings, such as slits, scores or perforations that would aid in easily bending the sheet material along the marking.

Figure 7:
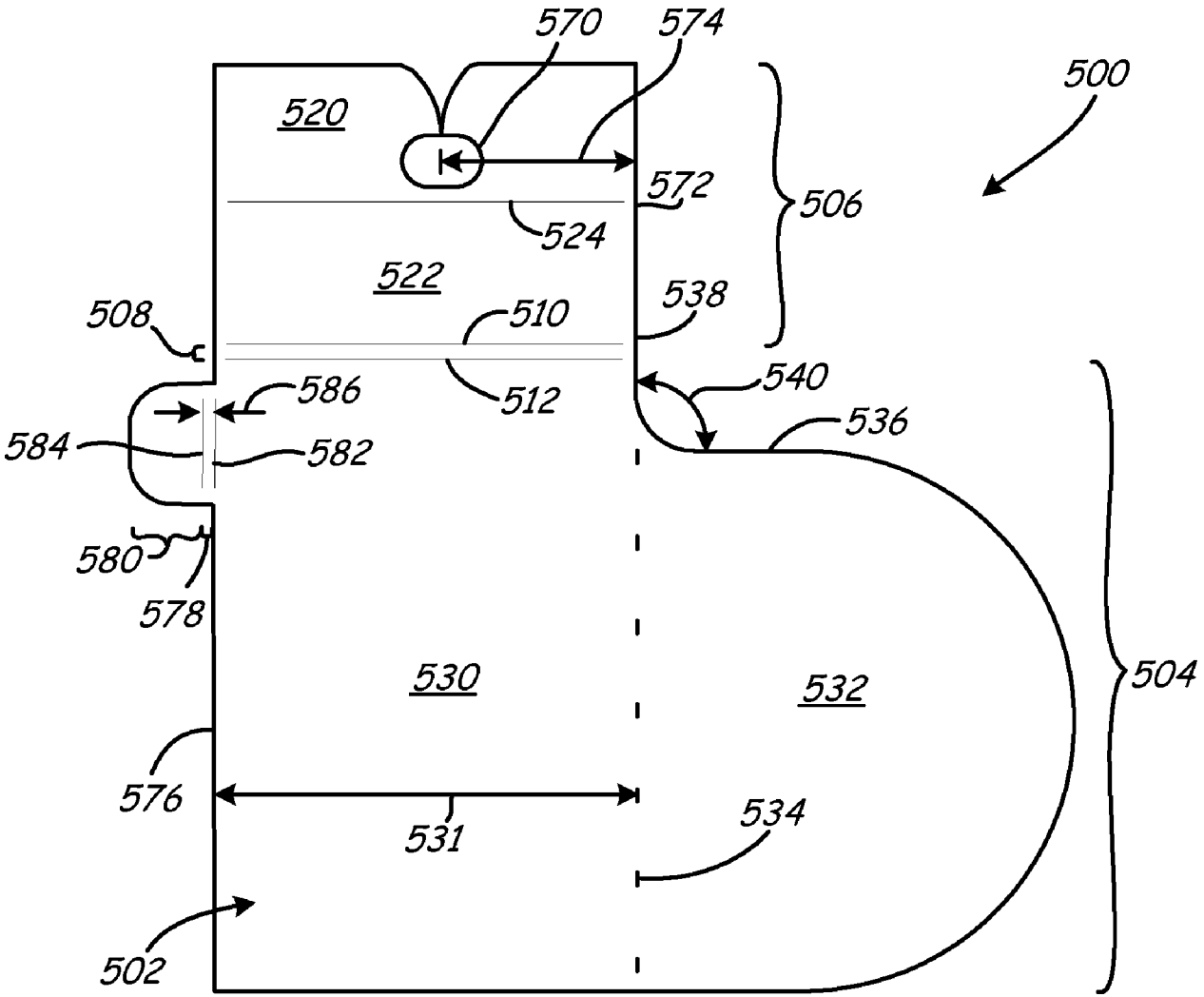
FIG. 7 is a front view of an in-store marketing sign for a peg-type display structure under another embodiment.

FIG. 7 is a front view of a marketing sign 500 showing a first surface 502 under another embodiment. Like marketing sign 400, marketing sign 500 is for use with a peg-type product display structure and is formed with a pliable yet resilient sheet material. Marketing sign 500 includes a free portion 504, a base portion 506 and a connecting portion 508, which couples the free portion 504 to the base portion 506 as similar to marketing sign 400.

Connecting portion 508 is defined between a first connecting bend line 510 spaced apart from a second connecting bend line 512. Base portion 506 includes engaging piece 520 coupled to support piece 522 at a base bend line 524. Free portion 504 includes a price piece 530 coupled to a balloon piece 532 at a free bend line 534.

Price piece 530 also includes a tab portion 580 coupled along a second side edge 576 of price piece 530 by a tab connecting portion 578. Tab connecting portion 578 is defined between a first tab bend line 582 spaced apart from a second tab bend line 584. First and second tab bend lines 582 and 584 are spaced apart by a distance 586. As illustrated, marketing sign 500 is no different than marketing sign 400, except, price piece 530 of marketing sign 500 is sized such that its width 531 is about 50.8 mm or 2 inches and the center of aperture 570 is spaced from a side edge 572 of base portion 506 by a distance 574. For example, distance 574 can be about 25.4 mm. Distance 474 of marketing sign 400 is less than distance 574 of marketing sign 500.

Figure 8:
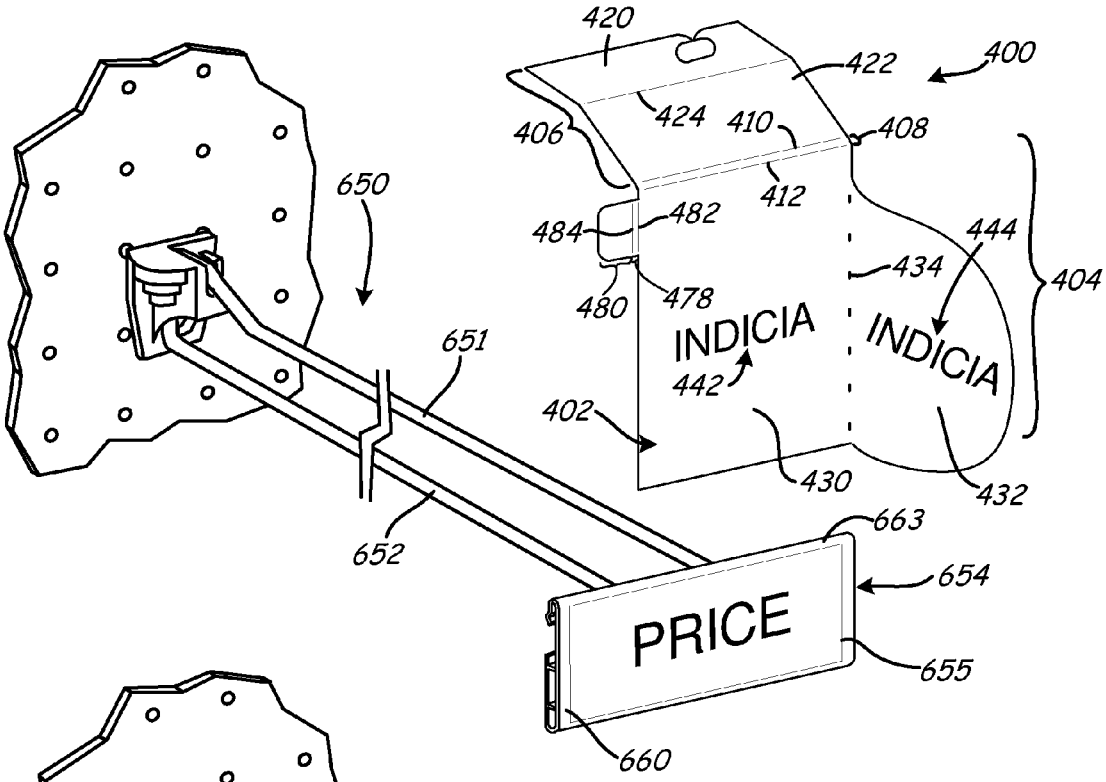
FIG. 8 is a perspective view of the in-store marketing sign illustrated in FIG. 6 as exploded from a peg-type display structure under one embodiment.

FIG. 8 is a perspective view of marketing sign 400 illustrated in FIG. 6 as exploded from a perspective view of a peg-type display structure 650 having a price label holder 654 under one embodiment. It should be noted that while marketing sign 400 (FIG. 6) is configured to fit with structure 650 and price holder 654, marketing sign 500 (FIG. 7) is configured to fit with a similar peg-type display structure and price label holder (not illustrated). In particular, the similar peg-type display structure includes peg fixtures that are positioned differently.

In FIG. 8, marketing sign 400 is bent at its bend lines. For example, first and second connecting bend lines 410 and 412 are bent such as to define connecting portion 408. Base bend line 424 is bent to define engaging piece 420 and support piece 422. Free bend line 434 is bent such that balloon piece 432 protrudes from front surface 402 of price piece 430. First tab bend line 482 and second tab bend line 484 are bent such as to define tab connecting portion 478.

Peg-type display structure 650 includes a top peg fixture 651 and a bottom peg fixture 652. Price holder 654 is coupled to a free end of top peg fixture 651. Bottom peg fixture 652 is configured to support product for display. Price holder 654 is configured to retain a price label 655, which is indicative of product information and price information of the product supported by bottom peg fixture 652.

Price holder 654 is typically formed of a polymer such as plastic, while top and bottom peg fixtures 651 and 652 are typically formed of a metal. At least front side 660 of price holder 654 is formed of a transparent polymer such that a price label 655 can be clearly viewed. Price holder 654 includes a top edge 663 and sides. Price label 655 can be inserted into the price holder 654 from either side.

Marketing sign 400 is configured to be bent and then coupled to price holder 654 so as to cover the regular price label 655 with price piece 430 of free portion 404. In one embodiment, price piece 430 includes indicia 442 indicative of a price of a product and product information of which sign 400 is marketing and balloon piece 432 includes indicia 444 indicative of promotional information about the product the sign 400 is marketing. Indicia are also located on a back side of balloon piece 432 (not specifically illustrated) such that indicia on balloon piece 432 are double sided. Upon marketing sign 400 covering the regular price label 655, marketing sign 400 indicates a new price with indicia 442 located on price piece 430 and further highlights promotional features of the product with indicia 444 located on balloon piece 432.

Figure 9:
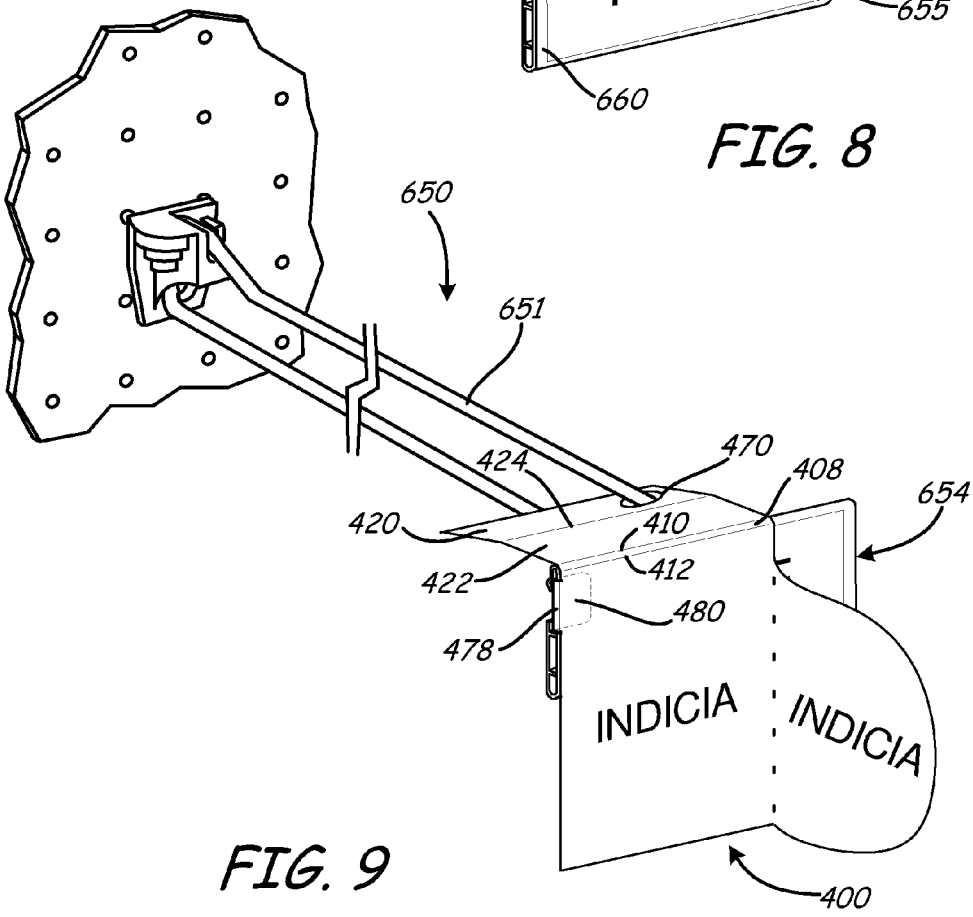
FIG. 9 is a perspective view of the in-store marketing sign illustrated in FIG. 6 as mounted to the peg-type display structure illustrated in FIG. 8.
Figure 10:
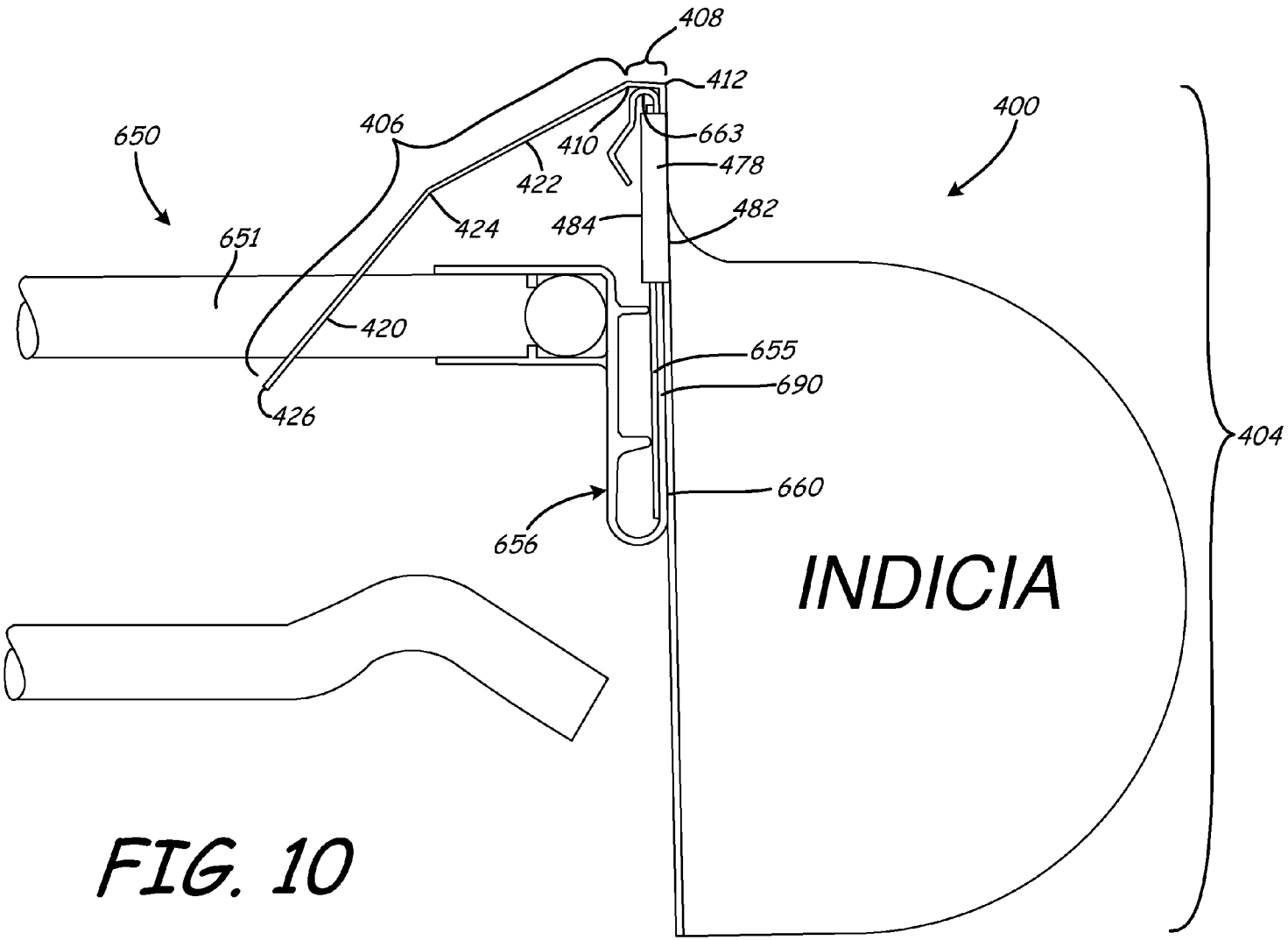
FIG. 10 is a side view of the in-store marketing sign mounted to the peg-type display structure illustrated in FIG. 9.

FIG. 9 is a perspective view of marketing sign 400 as mounted to a perspective view of peg-type display structure 650 after insertion. FIG. 10 is a side view of FIG. 9. As illustrated in FIGS. 9 and 10, marketing sign 400 is coupled to price holder 654 such that tab portion 480 is inserted into a side end of the price holder, base portion 406 engages with top peg fixture 651 and free portion 404 lies flat against front side 660 of price holder 654 and therefore in front of price label 655.

As illustrated in FIGS. 9 and 10, tab connecting portion 478 defined by first and second tab bend lines 482 and 484, which are spaced apart by distance 486 (FIG. 6), is sized to correspond at least with a thickness of a side edge 690 of price holder 654. By tab connecting portion 478 being sized to correspond with at least side edge 690 (FIG. 10), price label holder 654 is allowed to support free portion 404 of marketing sign 400 against front side 660 of the price holder 654. More specifically, distance 486 (FIG. 6) is sized to correspond with a thickness of a side edge 609 and thickness of price label 655.

Base bend line 424 is bent such that top peg fixture 651 is located within aperture 470 of engaging piece 420, which is in communication with base edge 426 via slot 471 (FIG. 6). In such a configuration, marketing sign 400 is secured to peg-type display structure 650. It should be realized, however, that base portion 406 can be coupled to peg fixture 651 with other attachment means without the need for aperture 470 and slot 471. For example, base portion 406 can couple to peg fixture 651 using an adhesive or clip.

Connecting portion 408 defined by first and second connecting bend lines 410 and 412, which are spaced apart by distance 414 (FIG. 6), is sized to correspond with a thickness of top edge 663 of price holder 654. By connecting portion 408 being sized to correspond with a thickness of top edge 663, top edge 663 is allowed to support connecting portion 408 of marketing sign 400 at first and second connecting bend lines 410 and 412 and be in contact with connecting portion 408. As illustrated in FIG. 10, free portion 404 is oriented substantially normal to connecting portion 408.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

What is claimed is:

1. A marketing sign comprising:

a sheet material comprising:

a free portion including a price piece having a first side edge and a second side edge and a balloon piece, the price piece and the balloon piece being coupled together at a free bend line that is in alignment with the second side edge of the price piece;

a base portion including a base edge configured to couple with a portion of a product display structure; and at least one connecting bend line coupling the free portion to the base portion and oriented substantially normal to the free bend line and the second side edge of the price piece, the at least one connecting bend line being different from the first side edge of the price piece.

2. The marketing sign of claim 1, wherein the at least one connecting bend line comprises a first connecting bend line and a second connecting bend spaced apart from each other by a first distance to define a connecting portion that couples the base portion to the free portion.

3. The marketing sign of claim 2, wherein the sheet material further comprises:

a tab portion; and a tab connecting portion that couples the tab portion to the free portion and is defined between a first tab bend line spaced apart from a second tab bend line by a second distance.

4. The marketing sign of claim 3, wherein the second distance at least substantially corresponds with a side edge thickness of a price holder.

5. The marketing sign of claim 1, wherein the price piece comprises indicia indicative of a price of a product of which the sign is marketing and the balloon piece comprises indicia indicative of information about the product.

6. The marketing sign of claim 1, wherein the free bend line comprises a plurality of spaced apart slits.

7. The marketing sign of claim 1, wherein the balloon piece comprises a top edge spaced apart from the at least one connecting bend line and the price piece comprises a side edge oriented substantially normal to the at least one connecting bend line, wherein the top edge of the balloon piece joins with the side edge of the price piece at an angle that is greater than 90 degrees and less than 180 degrees.

8. The marketing sign of claim 7, wherein a portion of the top edge of the balloon piece is partially curved.

9. A marketing sign comprising:

a free portion including a price piece having indicia indicative of a price of a product and a balloon piece having indicia indicative of information related to the product, the price piece and the balloon piece being coupled together at a free bend line and the price piece having a bottom free edge that is at least partially in alignment with and continuous with a bottom free edge of the balloon piece;

a base portion configured to couple with one of a price holder support structure and a price holder; and at least one connecting bend line coupling the base portion to the free portion, the at least one connecting bend line being substantially parallel with the bottom free edge of the price piece and at least a portion of the bottom free edge of the balloon piece and the at least one connecting bend line being different from the bottom free edge of the price piece.

10. The marketing sign of claim 9, wherein the base portion comprises a base edge configured to couple with one of an extension of the price holder and a bull nose of the product display structure.

11. The marketing sign of claim 9, wherein the free bend line is oriented substantially normal to the at least one connecting bend line.

12. The marketing sign of claim 11, wherein the marketing sign further comprises:

a tab portion; and a tab connecting portion that couples the tab portion to the free portion and defined between a first tab bend line spaced apart from a second tab bend line by a distance, wherein the distance at least substantially corresponds with a side edge thickness of the price holder.

13. A marketing sign comprising:

a sheet material comprising:

a base portion for engaging with a product display structure and having a base edge and a side edge that intersects with the base edge;

a free portion coupled to the base portion and including:

a price piece having indicia indicative of a price of a product and defined at least by a bottom free edge and a side edge, wherein the side edge of the price piece intersects with and is at least partially in linear alignment with the side edge of the base portion; and a balloon piece having indicia indicative of promotional features of the product and coupled to the price piece at a free bend line, wherein the balloon piece is defined at least by a bottom free edge and a top edge that intersects with the side edge of the price piece and is spaced apart from the base portion, wherein the free bend line intersects with and is substantially perpendicular to the bottom free edges of the price piece and the balloon piece and is in linear alignment with the side edge of the price piece and the side edge of the base portion.

14. The marketing sign of claim 13, wherein the balloon piece is further defined by a curved edge that is continuous with the top edge and the bottom free edge of the balloon piece.

15. The marketing sign of claim 13, wherein the price piece couples the balloon piece to the base portion.

16. The marketing sign of claim 13, further comprising at least one connecting bend line coupling the free portion to the base portion and oriented substantially normal to the free bend line.

17. The marketing sign of claim 16, wherein the at least one connecting bend line comprises a first connecting bend line and a second connecting bend line spaced apart from each other by a distance to define a connecting portion that couples the base portion to the free portion.

18. The marketing sign of claim 17, wherein the distance substantially corresponds with a top edge thickness of a price holder of the product display structure.

19. The marketing sign of claim 16, wherein the at least one connecting bend line is substantially parallel with the bottom free edge of the price piece and at least a portion of the bottom free edge of the balloon piece.

20. The marketing sign of claim 13, wherein the sheet material further comprises:

a tab portion; and a tab connecting portion that couples the tab portion to the free portion and is defined between a first tab bend line spaced apart from a second tab bend line by a distance.

* * * * *